US005816573A

United States Patent [19]

Bolling, Sr.

[11] Patent Number: 5,816,573

[45] Date of Patent: Oct. 6, 1998

[54] GIVE AND TAKE CARD GAME

[76] Inventor: Harold Lloyd Bolling, Sr., 220A Yonkers Ave. Apt. 1-B, Yonkers, N.Y. 10701

[21] Appl. No.: 808,803

[22] Filed: Feb. 28, 1997

[51] Int. Cl.[6] ..... A63F 1/00

[52] U.S. Cl. ..... 273/266; 273/292

[58] Field of Search ..... 273/266, 292, 273/146, 147, 304

[56] References Cited

U.S. PATENT DOCUMENTS

| | | | |
|---|---|---|---|
| 1,441,889 | 1/1923 | Stanley | 273/304 |
| 1,587,580 | 6/1926 | Dutton | 273/146 |
| 2,184,459 | 12/1939 | Lapointe | 273/147 |
| 4,378,942 | 4/1983 | Isaac | 237/278 |
| 4,421,312 | 12/1983 | Delgado | 273/236 |
| 4,856,784 | 8/1989 | Magee | 273/147 |

*Primary Examiner*—William M. Pierce

[57] ABSTRACT

A new Give and Take Card Game for offering an entertaining and exciting game wherein players attempt to accumulate a winning number of tokens. The inventive device includes a plurality of playing pieces, a plurality of tokens, and a plurality of playing cards each having a game instruction printed on a reverse side thereof, wherein the game instruction instructs a player to give a quantity of the plurality of playing pieces, to take a quantity of at least one of the plurality of playing pieces and the plurality of tokens, or to give a quantity of the plurality of playing pieces and to take a quantity of the plurality of tokens. Players select playing cards, and give and take playing pieces and tokens until a player accumulates a specified quantity of tokens.

15 Claims, 3 Drawing Sheets

GIVE AND TAKE CARD GAME

BACKGROUND OF THE INVENTION

1. Field of the Invention

The present invention relates to card games and more particularly pertains to a new Give and Take Card Game for offering an entertaining and exciting game wherein players attempt to accumulate a winning number of tokens.

2. Description of the Prior Art

The use of card games is known in the prior art. More specifically, card games heretofore devised and utilized are known to consist basically of familiar, expected and obvious structural configurations, notwithstanding the myriad of designs encompassed by the crowded prior art which have been developed for the fulfillment of countless objectives and requirements.

Known prior art card games include U.S. Pat. No. 5,382,025; U.S. Pat. No. 4,437,670; U.S. Pat. No. D329,063; U.S. Pat. No. 4,979,750; U.S. Pat. No. 4,693,480; and U.S. Pat. No. 4,078,803.

While these devices fulfill their respective, particular objectives and requirements, the aforementioned patents do not disclose a new Give and Take Card Game. The inventive device includes a plurality of playing pieces, a plurality of tokens, and a plurality of playing cards each having a game instruction printed on a reverse side thereof, wherein the game instruction instructs a player to give a quantity of the plurality of playing pieces, to take a quantity of at least one of the plurality of playing pieces and the plurality of tokens, or to give a quantity of the plurality of playing pieces and to take a quantity of the plurality of tokens.

In these respects, the Give and Take Card Game according to the present invention substantially departs from the conventional concepts and designs of the prior art, and in so doing provides an apparatus primarily developed for the purpose of offering an entertaining and exciting game wherein players attempt to accumulate a winning number of tokens.

SUMMARY OF THE INVENTION

In view of the foregoing disadvantages inherent in the known types of card games now present in the prior art, the present invention provides a new Give and Take Card Game construction wherein the same can be utilized for offering an entertaining and exciting game wherein players attempt to accumulate a winning number of tokens.

The general purpose of the present invention, which will be described subsequently in greater detail, is to provide a new Give and Take Card Game apparatus and method which has many of the advantages of the card games mentioned heretofore and many novel features that result in a new Give and Take Card Game which is not anticipated, rendered obvious, suggested, or even implied by any of the prior art card games, either alone or in any combination thereof.

To attain this, the present invention generally comprises a plurality of playing pieces, a plurality of tokens, and a plurality of playing cards each having a game instruction printed on a reverse side thereof, wherein the game instruction instructs a player to give a quantity of the plurality of playing pieces, to take a quantity of at least one of the plurality of playing pieces and the plurality of tokens, or to give a quantity of the plurality of playing pieces and to take a quantity of the plurality of tokens.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new Give and Take Card Game apparatus and method which has many of the advantages of the card games mentioned heretofore and many novel features that result in a new Give and Take Card Game which is not anticipated, rendered obvious, suggested, or even implied by any of the prior art card games, either alone or in any combination thereof.

It is another object of the present invention to provide a new Give and Take Card Game which may be easily and efficiently manufactured and marketed.

It is a further object of the present invention to provide a new Give and Take Card Game which is of a durable and reliable construction.

An even further object of the present invention is to provide a new Give and Take Card Game which is susceptible of a low cost of manufacture with regard to both materials and labor, and which accordingly is then susceptible of low prices of sale to the consuming public, thereby making such Give and Take Card Game economically available to the buying public.

Still yet another object of the present invention is to provide a new Give and Take Card Game which provides in the apparatuses and methods of the prior art some of the advantages thereof, while simultaneously overcoming some of the disadvantages normally associated therewith.

Still another object of the present invention is to provide a new Give and Take Card Game for offering an entertaining and exciting game wherein players attempt to accumulate a winning number of tokens.

Yet another object of the present invention is to provide a new Give and Take Card Game which includes a plurality of playing pieces, a plurality of tokens, and a plurality of playing cards each having a game instruction printed on a reverse side thereof, wherein the game instruction instructs a player to give a quantity of the plurality of playing pieces, to take a quantity of at least one of the plurality of playing pieces and the plurality of tokens, or to give a quantity of the plurality of playing pieces and to take a quantity of the plurality of tokens.

Still yet another object of the present invention is to provide a new Give and Take Card Game that provides an enjoyable game that could be participated in for friendly competition and entertainment.

Even still another object of the present invention is to provide a new Give and Take Card Game that can be played by children and adults.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 2:
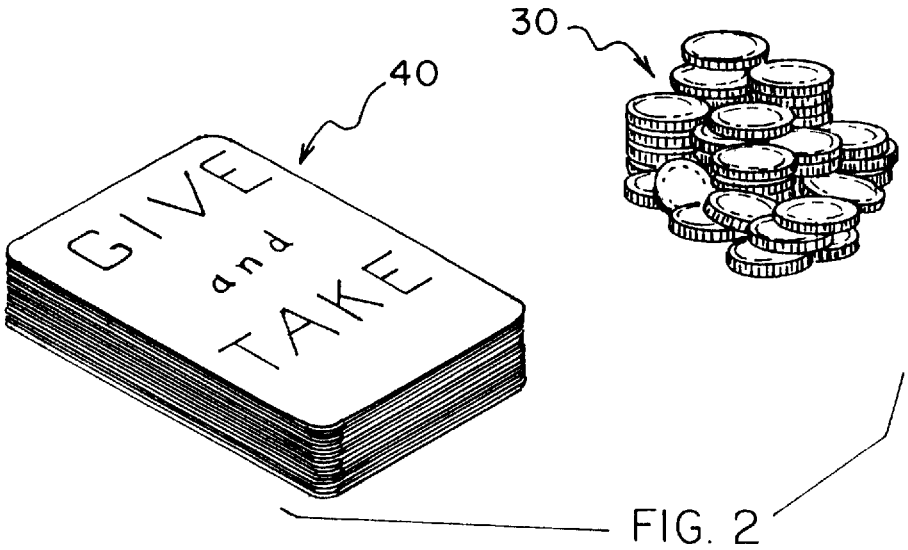
FIG. 2 is an illustration of a plurality of playing cards and a plurality of tokens of the present invention.

With reference now to the drawings, and in particular to FIGS. 1 through 5 thereof, a new Give and Take Card Game embodying the principles and concepts of the present invention and generally designated by the reference numeral 10 will be described.

More specifically, it will be noted that the Give and Take Card Game 10 comprises a plurality of playing pieces 20, a plurality of tokens 30, and a plurality of playing cards 40 each having a game instruction 42 printed on a reverse side 41 thereof, wherein the game instruction 42 instructs a player to give a quantity of the plurality of playing pieces 20, to take a quantity of at least one of the plurality of playing pieces 20 and the plurality of tokens 30, or to give a quantity of the plurality of playing pieces 20 and to take a quantity of the plurality of tokens 30.

Figure 1:
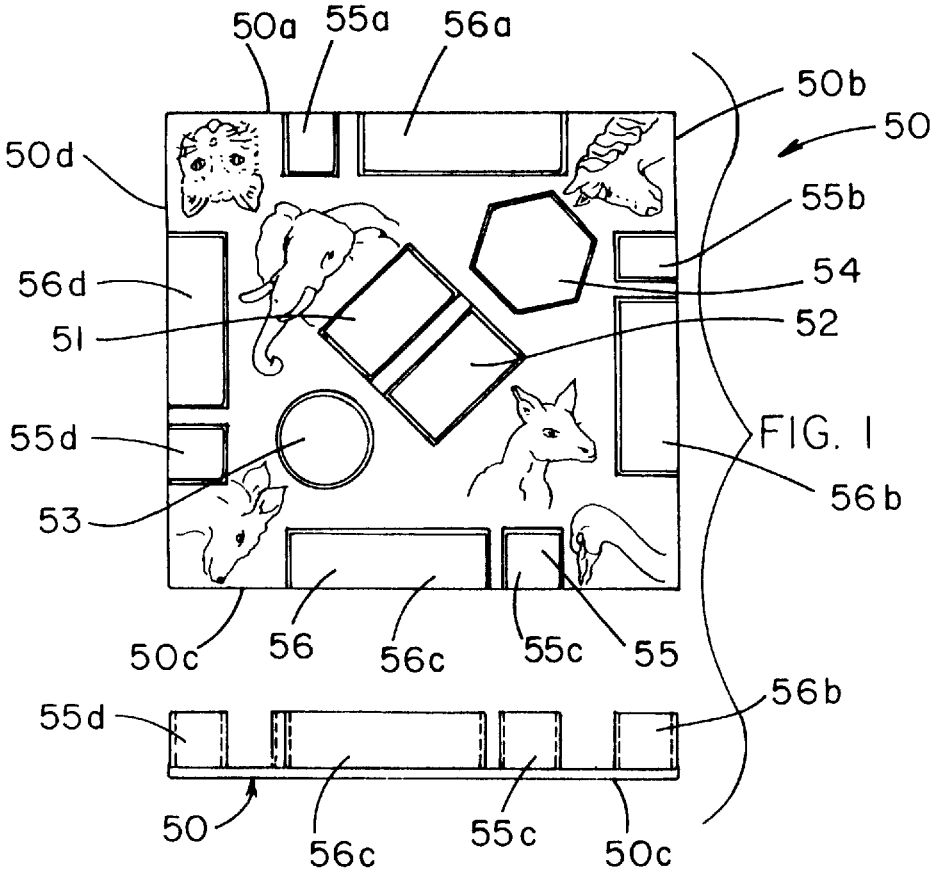
FIG. 1 is a top view and a side view of a game board of a new Give and Take Card Game according to the present invention.

As best illustrated in FIG. 1, it can be shown that a game board 50 is provided. The game board 50 is generally square in shape and has a first side 50*a*, a second side 50*b*, a third side 50*c*, and a fourth side 50*d*. The game board 50 includes a playing card supply area 51 and a playing card discard area 52. The playing card supply area 51 and the playing card discard area 52 are provided in a center portion of the game board 50. A token supply tray 53 and a playing piece supply tray 54 are provided on the game board 50. The token supply tray 53 is adapted to contain the plurality of tokens 30 and the playing piece supply tray 54 is adapted to contain the plurality of playing pieces 20. An accumulated token tray 55 and an accumulated playing piece tray 56 are provided on each of the sides 50*a*, 50*b*, 50*c*, and 50*d* of the game board 50. The accumulated token tray 55 is adapted to contain a quantity of the plurality of tokens 30 accumulated by a player during play of the game 10. The accumulated playing piece tray 56 is adapted to contain a quantity of the plurality of playing pieces 20 accumulated by a player during play of the game 10. A first accumulated token tray 55*a* and a first accumulated playing piece tray 56*a* are provided adjacent the first side 50*a* of the game board 50, a second accumulated token tray 55*b* and a second accumulated playing piece tray 56*b* are provided adjacent the second side 50*b* of the game board 50, a third accumulated token tray 55*c* and a third accumulated playing piece tray 56*c* are provided adjacent the third side 50*c* of the game board 50, and a fourth accumulated token tray 55*d* and a fourth accumulated playing piece tray 56*d* are provided adjacent the fourth side 50*d* of the game board 50. The game 10 can be played with or without the game board 50. The game board 50 is designed to accommodate up to four players. If more than four players are playing the game 10, a table or other flat surface can be used.

As best illustrated in FIG. 2, it can be shown that each of the plurality of tokens 30 is circular shaped. A quantity of tokens is provided with the game 10. In an illustrative embodiment, the quantity of tokens is twenty-five (25).

Figure 3:
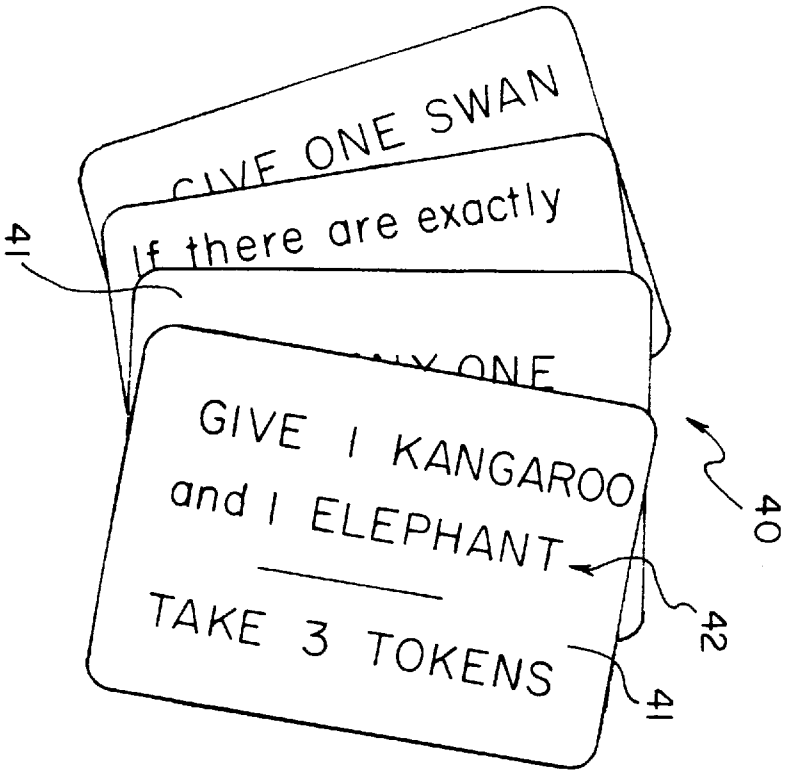
FIG. 3 is an exemplary illustration of the reverse side of the plurality of playing cards of the present invention.
Figure 4:
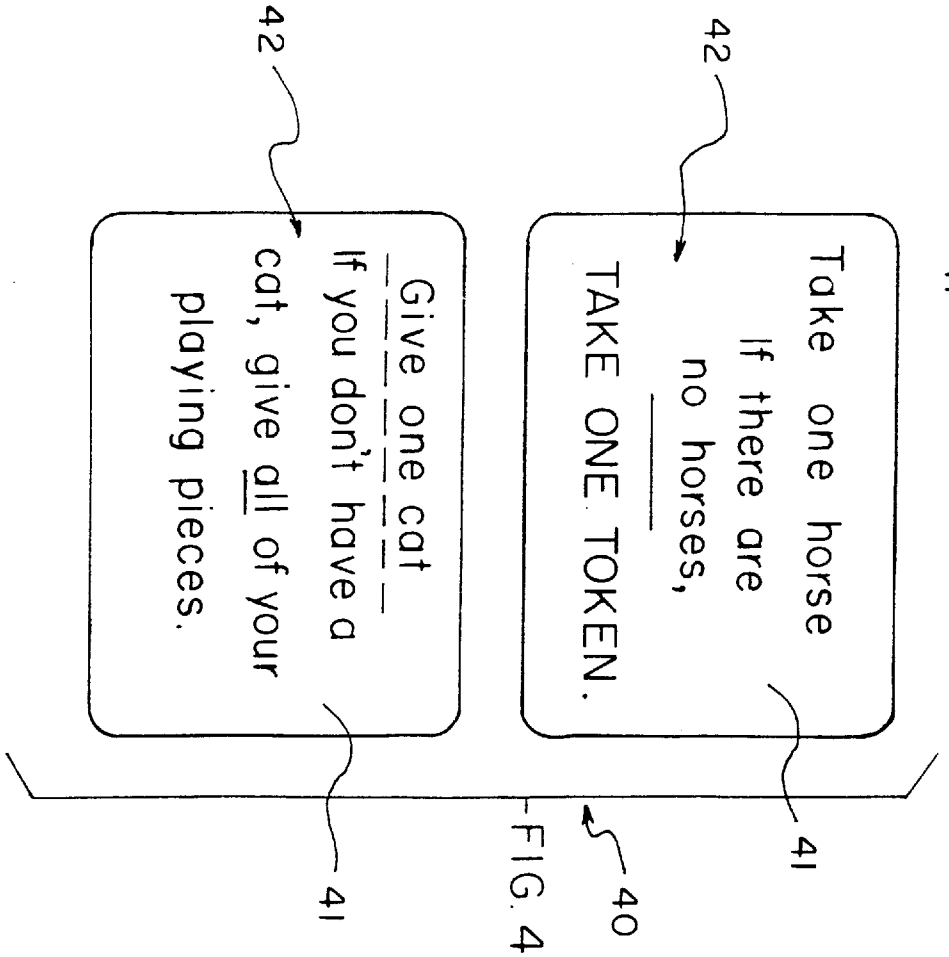
FIG. 4 is an exemplary illustration of the instructions present on the reverse side of the plurality of playing cards of the present invention.

As best illustrated in FIG. 2, it can be shown that a plurality of playing cards 20 are provided. As best illustrated in FIGS. 3 and 4, it can be shown that each of the plurality of playing cards 20 has a game instruction 42 printed on a reverse side 41 thereof. The game instruction 42 instructs a player to give a quantity of the plurality of playing pieces 20, to take a quantity of at least one of the plurality of playing pieces 20 and the plurality of tokens 30, or to give a quantity of the plurality of playing pieces 20 and to take a quantity of the plurality of tokens 30. Listed below are examples of the game instructions 42 provided on the reverse side 41 of each of the plurality of playing cards 40:

GIVE 1 CAT.
GIVE 1 DOG.
GIVE 1 DEER.
GIVE 1 HORSE.
GIVE ANY 1 PLAYING PIECE.
GIVE 1 CAT. IF YOU DON'T HAVE 1 CAT, GIVE ALL YOUR PLAYING PIECES.
TAKE 1 CAT.
TAKE 1 DOG.
TAKE 1 DEER
TAKE 1 SWAN.
TAKE 1 HORSE.
TAKE 1 ELEPHANT
TAKE 1 KANGAROO.
TAKE ANY 1 PLAYING PIECE.
TAKE 1 HORSE. IF THERE ARE NO HORSES, TAKE 1 TOKEN.
GIVE 1 SWAN. TAKE 1 TOKEN.
GIVE 1 KANGAROO. TAKE 1 TOKEN.
GIVE 1 ELEPHANT. TAKE 1 TOKEN.

GIVE 2 DOGS. TAKE 1 TOKEN.
GIVE 3 DEER. TAKE 1 TOKEN.
GIVE 3 HORSES. TAKE 1 TOKEN.
GIVE 3 DOGS. TAKE 1 TOKEN.
GIVE 4 CATS. TAKE 2 TOKENS.
GIVE 1 CAT AND 1 DOG. TAKE 1 TOKEN.
GIVE 1 DEER AND 1 HORSE. TAKE 1 TOKEN.
GIVE 1 SWAN AND 1 HORSE. TAKE 2 TOKENS.
GIVE 1 SWAN AND 1 ELEPHANT. TAKE 2 TOKENS.
GIVE 1 KANGAROO AND 1 ELEPHANT. TAKE 3 TOKENS.
GIVE 1 SWAN, 1 ELEPHANT, AND 1 HORSE. TAKE 3 TOKENS.
GIVE 1 KANGAROO, 1 ELEPHANT, AND 1 SWAN. TAKE 4 TOKENS.
GIVE 1 DOG, 1 CAT, 1 HORSE, AND 1 DEER. TAKE 4 TOKENS.
GIVE 2 DEER AND 1 CAT. TAKE 1 TOKEN.
GIVE 2 HORSES AND 2 DEER. TAKE 2 TOKENS.
IF THERE ARE EXACTLY 2 DEER, TAKE BOTH OF THEM.
IF THERE ARE EXACTLY 2 HORSES, TAKE BOTH OF THEM.
IF YOU ALREADY HAVE 1 HORSE AND 1 DEER, TAKE 1 DOG AND 1 CAT.

Figure 5:
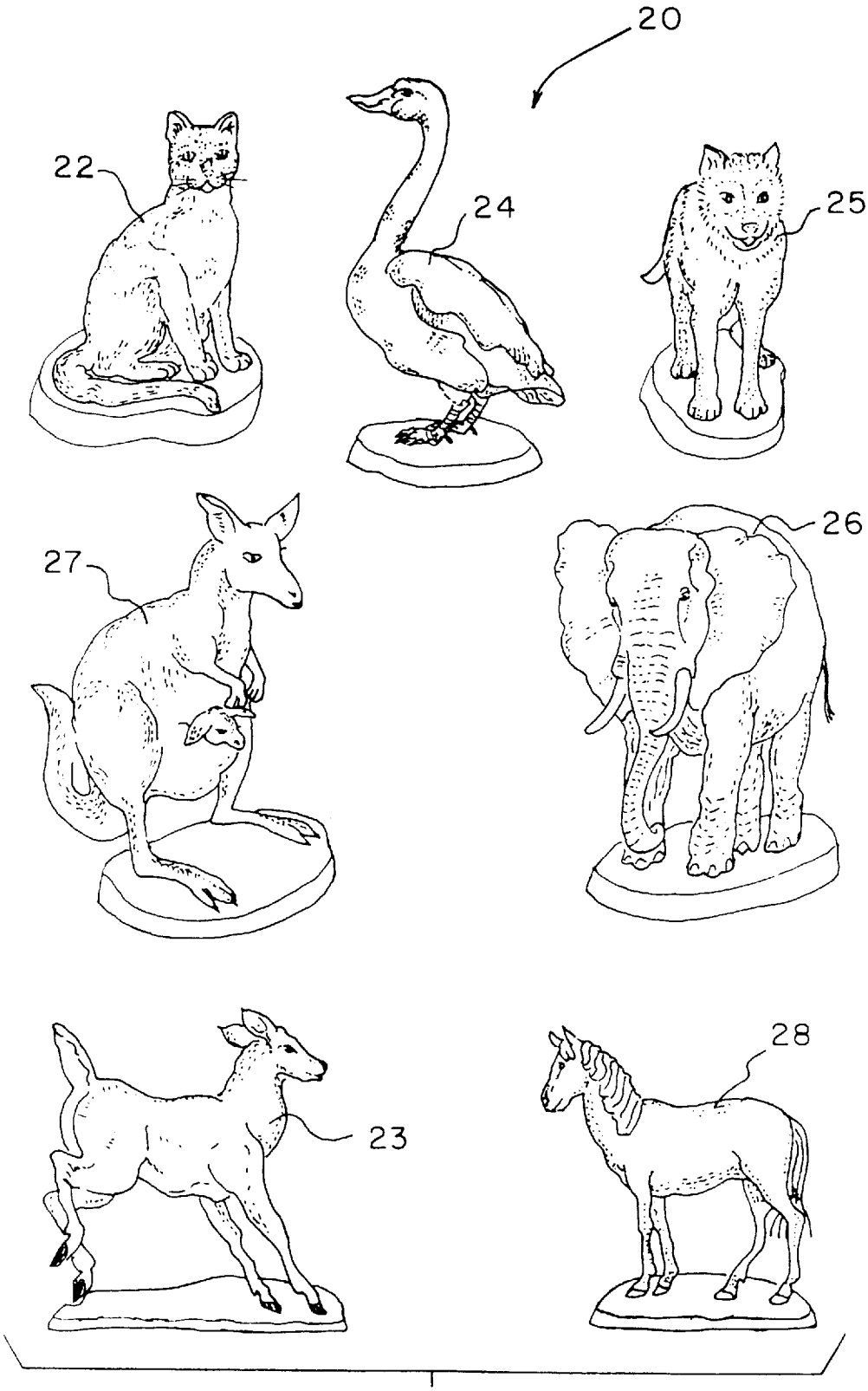
FIG. 5 is an illustration of the playing pieces of the present invention.

As best illustrated in FIG. 5, it can be shown that each of the plurality of playing pieces 20 are in the shape of an animal 21. The animal 21 comprises at least one of a cat 22, a deer 23, a swan 24, a dog 25, an elephant 26, a kangaroo 27, and a horse 28. A quantity of each of the animals is provided with the game 10. In an illustrative embodiment, the quantity of cats is seven (7), the quantity of deer is five (5), the quantity of swans is five (5), the quantity of dogs is four (4), the quantity of elephants is four (4), the quantity of kangaroos is three (3), and the quantity of horses is three (3).

To play the game, a plurality of playing pieces 20, a plurality of tokens 30, and a plurality of playing cards 40 each having a game instruction 42 printed on a reverse side 41 thereof are provided, wherein the game instruction 42 instructs a player to give a quantity of the plurality of playing pieces 20, to take a quantity of at least one of the plurality of playing pieces 20 and the plurality of tokens 30, or to give a quantity of the plurality of playing pieces 20 and to take a quantity of the plurality of tokens 30. A game board 50 is provided wherein the game board 50 includes a playing card supply area 51, a playing card discard area 52, a token supply tray 53, a playing piece supply tray 54, an accumulated token tray 55, and an accumulated playing piece tray 56.

To begin play, the plurality of playing cards 40 are positioned in the playing card supply area 51 of the game board 50, the plurality of playing pieces 20 are positioned in the playing piece supply tray 54 of the game board 50, and the plurality of tokens 30 are positioned in the token supply tray 53 of the game board 50. A player selects one of the plurality of playing cards 40 and follows the game instruction 42 provided on the reverse side 41 thereof. As such, the player gives a quantity of the plurality of playing pieces 20, takes a quantity of at least one of the plurality of playing pieces 20 and the plurality of tokens 30, or gives a quantity of the plurality of playing pieces 20 and takes a quantity of the plurality of tokens 30.

When a player is instructed to give a quantity of the plurality of playing pieces 20, the player selects the playing piece from his or her accumulated playing piece tray 56 and places the playing piece in the playing piece supply tray 54. When a player is instructed to take a quantity of the plurality of playing pieces 20, the player selects the playing piece from the playing piece supply tray 54 and places the playing piece in his or her accumulated playing piece tray 56. When a player is instructed to take a quantity of the plurality of tokens 30, the player selects the token from the token supply tray 53 and places the token in his or her accumulated token tray 55. When a player is instructed to give a quantity of the plurality of playing pieces 20 and take a quantity of the plurality of tokens 30, the player selects the playing piece from his or her accumulated playing piece tray 56 and places the playing piece in the playing piece supply tray 54, and selects the token from the token supply tray 53 and places the token in his or her accumulated token tray 55.

If a player cannot comply with the game instruction 42, the player's turn is over. When a player's turn is completed, the player discards the selected playing card in the playing card discard area 52 and play advances to the next player. Play continues with players selecting playing cards 40, and giving and taking playing pieces 20 and tokens 30 until a player accumulates a specified quantity of tokens. In an illustrative embodiment, the specified quantity of tokens is five (5).

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A give and take card game comprising:

a plurality of playing pieces;

a plurality of tokens;

a plurality of playing cards, each of said plurality of playing cards having a game instruction printed on a reverse side thereof, said game instruction instructing a player to perform at least one of giving a quantity of at least one of said plurality of playing pieces said plurality of tokens, taking a quantity of at least one of said plurality of playing pieces and said plurality of tokens, and giving a quantity of said plurality of playing pieces and taking a quantity of said said game, said accumulated playing piece compartment having perimeter walls adapted to contain a quantity of said plurality of playing pieces accumulated by a player during said game.

2. The give and take card game claim 1 further comprising:

a game board, said game board including a playing card supply area, a playing card discard area, a token supply compartment, a playing piece supply compartment, an accumulated token compartment, and an accumulated playing piece compartment, said token supply compartment having perimeter walls adapted to contain said plurality of tokens, said playing piece supply compartment having perimeter walls adapted to contain said plurality of playing pieces, said accumulated token compartment having perimeter walls adapted to contain a quantity of said plurality of tokens accumulated by a player during said game, said accumulated playing piece compartment having perimeter walls adapted to contain a quantity of said plurality of playing pieces accumulated by a player during said game.

3. The give and take card game of claim 1 wherein each of said plurality of tokens is circular shaped.

4. The give and take card game of claim 1 wherein as quantity of tokens is provided with said game, said quantity of tokens being twenty-five.

5. The give and take card game of claim 1 wherein each of said plurality of playing pieces are shaped like an animal.

6. The give and take card game of claim 5, wherein said animal comprises at least one of a cat, a deer, a swan, a dog, an elephant, a kangaroo, and a horse.

7. The give and take card game of claim 6, wherein a quantity of said playing pieces shaped to resemble the same animal is provided with said game, said quantity of said playing pieces shaped to resemble a cat being seven, said quantity of said playing pieces shaped to resemble a deer being five, said quantity of said playing pieces shaped to resemble a swan being five, said quantity of said playing pieces shaped to resemble a dog being four, said quantity of said playing pieces shaped to resemble an elephant being four, said quantity of said playing pieces shaped to resemble a kangaroo being three, and said quantity of said playing pieces shaped to resemble a horse being three.

8. A give and take card game comprising:

a plurality of playing pieces;

a plurality of tokens;

a plurality of playing cards, each of said plurality of playing cards having a game instruction printed on a reverse side thereof, said game instruction instructing a player to perform at least one of giving a quantity of at least one of said plurality of playing pieces said plurality of tokens, taking a quantity of at least one of said plurality of playing pieces and said plurality of tokens, and giving a quantity of said plurality of playing pieces and taking a quantity of said plurality of tokens;

wherein each of said plurality of playing pieces are shaped like an animal;

wherein said animal comprises at least one of a cat, a deer, a swan, a dog, an elephant, a kangaroo, and a horse; and wherein a quantity of said playing pieces shaped to resemble the same animal is provided with said game, said quantity of said playing pieces shaped to resemble a cat being seven, said quantity of said playing pieces shaped to resemble a deer being five, said quantity of said playing pieces shaped to resemble a swan being five, said quantity of said playing pieces shaped to resemble a dog being four, said quantity of said playing pieces shaped to resemble an elephant being four, said quantity of said playing pieces shaped to resemble a kangaroo being three, and said quantity of said playing pieces shaped to resemble a horse being three.

9. The give and take card game of claim 8 additionally comprising a game board having a first side, a second side, a third side, and a fourth side, wherein said playing card supply area and said playing card discard area are provided in a center portion of said game board, and wherein said accumulated token compartment and said accumulated playing piece compartment are provided on each of said first side, said second side, said third side, and said fourth side of said game board.

10. The give and take card game of claim 9, wherein a first accumulated token compartment and a first accumulated playing piece compartment are provided adjacent said first side of said game board, a second accumulated token compartment and a second accumulated playing piece compartment are provided adjacent said second side of said game board, a third accumulated token compartment and a third accumulated playing piece compartment are provided adjacent said third side of said game board, and a fourth accumulated token compartment and a fourth accumulated playing piece compartment are provided adjacent said fourth side of said game board.

11. The give and take card game claim 8 further comprising:

a game board, said game board including a playing card supply area, a playing card discard area, a token supply compartment, a playing piece supply compartment, an accumulated token compartment, and an accumulated playing piece compartment, said token supply compartment having perimeter walls adapted to contain said plurality of tokens, said playing piece supply compartment having perimeter walls adapted to contain said plurality of playing pieces, said accumulated token compartment having perimeter walls adapted to contain a quantity of said plurality of tokens accumulated by a player during said game, said accumulated playing piece compartment having perimeter walls adapted to contain a quantity of said plurality of playing pieces accumulated by a player during said game.

12. The give and take card game of claim 8, wherein each of said plurality of tokens is circular shaped.

13. The give and take card game of claim 8, wherein a quantity of tokens is provided with said game, said quantity of tokens being twenty-five.

14. A method of playing a give and take card game, comprising the steps of (a) providing a plurality of playing pieces;

(b) providing a plurality of tokens;

(c) providing a plurality of playing cards, each of said plurality of playing cards having a game instruction printed on a reverse side thereof, said game instruction instructing a player to perform at least one of giving a quantity of said plurality of playing pieces, taking a quantity of at least one of said plurality of playing pieces and said plurality of tokens, and giving a quantity of said plurality of playing pieces and taking a quantity of said plurality of tokens;

(d) selecting one of said plurality of playing cards;

(e) following said game instruction provided on said selected playing card by performing at least one of giving a quantity of at least one of said plurality of playing pieces and said plurality of tokens, taking a quantity of at least one of said plulality of playing pieces and said plurality of tokens, giving a quantity of said plurality of playing pieces and taking a quantity of said plurality of tokens, and disregarding said game instruction if a player cannot comply with said game instruction; and (f) repeating steps (d) and (e) above until a player accumulates a specified quantity of tokens and playing pieces.

15. A give and take card game comprising:

a plurality of playing pieces, each of said playing pieces resembling an animal chosen from the group of animals consisting of a cat, a deer, a swan, a dog, an elephant, a kangaroo, and a horse;

a plurality of circular shaped tokens;

a plurality of playing cards, each of said plurality of playing cards having a game instruction printed on a reverse side thereof, said game instruction instructing a player to perform at least one of giving a quantity of at least one of said plurality of playing pieces said plurality of tokens, taking a quantity of at least one of said plurality of playing pieces and said plurality of tokens, and giving a quantity of said plurality of playing pieces and taking a quantity of said plurality of tokens;

a game board, said game board including a playing card supply area, a playing card discard area, a token supply compartment, a playing piece supply compartment, an accumulated token compartment, and an accumulated playing piece compartment, said token supply compartment having perimeter walls adapted to contain said plurality of tokens;

said playing piece supply compartment having perimeter walls adapted to contain said plurality of playing pieces;

said accumulated token compartment having perimeter walls adapted to contain a quantity of said plurality of tokens accumulated by a player during said game;

said accumulated playing piece compartment having perimeter walls adapted to contain a quantity of said plurality of playing pieces accumulated by a player during said game;

said game board has a first side, a second side, a third side, and a fourth side, wherein said playing card supply area and said playing card discard area are provided in a center portion of said game board;

wherein said accumulated token compartment and said accumulated playing piece compartment are provided on each of said first side, said second side, said third side, and said fourth side of said game board;

wherein a first accumulated token compartment and a first accumulated playing piece compartment are provided adjacent said first side of said game board, a second accumulated token compartment and a second accumulated playing piece compartment are provided adjacent said second side of said game board, a third accumulated token compartment and a third accumulated playing piece compartment are provided adjacent said third side of said game board, and a fourth accumulated token compartment and a fourth accumulated playing piece compartment are provided adjacent said fourth side of said game board; and wherein a quantity of said playing pieces shaped to resemble the same animal is provided with said game, said quantity of said playing pieces shaped to resemble a cat being seven, said quantity of said playing pieces shaped to resemble a deer being five, said quantity of said playing pieces shaped to resemble a swan being five, said quantity of said playing pieces shaped to resemble a dog being four, said quantity of said playing pieces shaped to resemble an elephant being four, said quantity of said playing pieces shaped to resemble a kangaroo being three, and said quantity of said playing pieces shaped to resemble a horse being three.

* * * * *